US011312553B1

(12) United States Patent
Yeh

(10) Patent No.: US 11,312,553 B1
(45) Date of Patent: Apr. 26, 2022

(54) PAPER CUP-HOLDER

(71) Applicant: Ya-Ming Yeh, New Taipei (TW)

(72) Inventor: Ya-Ming Yeh, New Taipei (TW)

( * ) Notice: Subject to any disclaimer, the term of this patent is extended or adjusted under 35 U.S.C. 154(b) by 0 days.

(21) Appl. No.: 17/154,552

(22) Filed: Jan. 21, 2021

(51) Int. Cl.
*B65D 71/62* (2006.01)

(52) U.S. Cl.
CPC .... *B65D 71/004* (2013.01); *B65D 2571/0029* (2013.01); *B65D 2571/0066* (2013.01); *B65D 2571/00141* (2013.01); *B65D 2571/00456* (2013.01)

(58) Field of Classification Search
CPC ..... B65D 71/00; B65D 71/0022; B65D 2571/00141; B65D 2571/0029; B65D 2571/0037; B65D 2571/00456; B65D 2571/00487; B65D 2571/0066; B65D 2571/00728; B65D 2571/00932; B65D 71/004; B65D 71/062
USPC ..... 206/141, 162, 193, 197, 434; 229/117.09, 117.18, 120.14
See application file for complete search history.

(56) References Cited

U.S. PATENT DOCUMENTS 2,613,867 A * 10/1952 Darr ..... B65D 5/46088 229/117.18
3,104,046 A * 9/1963 Arneson ..... B65D 71/0022 229/117.18
3,897,873 A * 8/1975 Graser ..... B65D 71/48 206/153

FOREIGN PATENT DOCUMENTS

TW M577004 U 4/2019
TW M595102 U 5/2020

* cited by examiner

*Primary Examiner* — Bryon P Gehman
(74) *Attorney, Agent, or Firm* — Muncy, Geissler, Olds & Lowe, P.C.

(57) ABSTRACT

The invention provides a paper cup-holder comprising first and second wall plates respectively bent relative to the bottom plate; a support plate bent relative to the first wall plate and being parallel to the bottom plate; a panel bent relative to the second wall plate and fixed on the support plate. The panel is formed with two sets of handle forming lines and at least two cup receiving inlet forming lines. Each set of handle forming lines comprises an outer cutting line and an inner cutting line, and a starting point and an ending point of the cup receiving inlet forming lines are located on the inner cutting line. Two hollowed areas are formed when the two handles are formed from the panel, and respectively form a cup receiving inlet together with at least one of the cup receiving inlet forming lines.

5 Claims, 22 Drawing Sheets

PAPER CUP-HOLDER

FIELD OF THE INVENTION

The invention relates to a cup-holder, in particular to a paper cup-holder.

BACKGROUND OF THE INVENTION

A conventional cup-holder is revealed in Taiwan patent Nos. TW M595102, TW M577004 and so on, respectively. First of all, a cup-holder provided by the patent No. TW M595102 is a plate structure without a bottom support. That is to say, a beverage cup is positioned in the cup-holder through a mounting opening on the plate structure. However, the cup-holder limits a size of the cup for placing thereon, and the beverage cup is unable to be positioned by the mounting opening once a diameter of the beverage cup is too small, as a result, the beverage cup will be fell out from the mounting opening cup-holder. In addition, a cup-holder provided by the patent No. TW M577004 solves the problem that the beverage cup may fall out from the cup-holder. However, the cup-holder is directly formed in a fixed structure and is unable to be tightly stacked during transportation or storage, so that a carrier or a beverage vender has to make a room for the cup-holder to be placed, which cannot avoid wasting space instead of reducing the number of transporting or storing the cup-holder.

SUMMARY OF THE INVENTION

The main purpose of the present invention is to solve problems due to an insufficient conventional structure.

To achieve the above purpose, the present invention provides a paper cup-holder comprising a bottom plate, a first wall plate, a second wall plate, a support plate and a panel. The first wall plate and the second wall plate respectively extend integrally from two opposite sides of the bottom plate and are bendable relative to the bottom plate. The support plate integrally extends from the first wall plate and is bendable relative to the first wall plate to be parallel to the bottom plate, wherein at least one opening is formed in the support plate. The panel integrally extends from the second wall plate and is bendable relative to the second wall plate to be superposed on the support plate, wherein the panel is fixed on the support plate, the panel is formed with two symmetrically disposed sets of handle forming lines and at least two cup receiving inlet forming lines, each set of handle forming lines includes an outer cutting line and an inner cutting line facing the other set of handle forming lines, and a starting point and an ending point of each of the cup receiving inlet forming lines are located on the inner cutting line, and two hollowed areas are formed on the panel when two handles are formed from the panel based on the two sets of handle forming lines, and the two hollowed areas respectively form a cup receiving inlet corresponding to the at least one opening together with at least one of the cup receiving inlet forming lines.

In an embodiment, the support plate comprises a plurality of openings formed therein, and one of the plurality of openings is disposed correspondingly to one of the cup receiving inlets.

In an embodiment, each of the cup receiving inlet forming lines is a cutting line.

In an embodiment, each of the cup receiving inlet forming lines is configured in an arc shape.

In an embodiment, the at least one of the cup receiving inlet forming lines facing each of the inner cutting lines has an equal number.

In an embodiment, the support plate comprises at least one opening forming line for forming the at least one opening, and each of the at least one opening forming line comprises two transverse cutting lines spaced apart and a longitudinal cutting line connected with the two transverse cutting lines.

In an embodiment, the support plate comprises at least one opening forming line for forming the at least one opening, a starting point and an ending point of the opening forming line are unconnected, and a first auxiliary support piece is formed from the support plate when the at least one opening is formed from the support plate based on the opening forming line, and the first auxiliary support piece comprises a first side plate bent towards a direction facing the bottom plate, and a first bonding plate connected with the first side plate and adhered to the bottom plate.

In an embodiment, the support plate comprises a plurality of opening forming lines, and a plurality of first auxiliary support pieces is formed by bending the support plate towards a same direction when a plurality of openings is formed by the plurality of opening forming lines.

In an embodiment, the bottom plate comprises at least one auxiliary support piece forming line, a starting point and an ending point of the at least one auxiliary support piece forming line are unconnected, and a second auxiliary support piece is formed from the bottom plate based on the at least one auxiliary support piece forming line, and the second auxiliary support piece comprises a second side plate bent towards a direction facing the support plate and a second bonding plate connected with the second side plate and adhered to the support plate.

In an embodiment, the panel defines an extension line extending in an alignment direction of the second wall plate, the bottom plate, the first wall plate, and the support plate, and long sides of the two handles are arranged parallel to the extension line.

In addition to the foregoing, the present invention also provides a paper cup-holder comprising a bottom plate, a first wall plate, a second wall plate, a panel, and a joint plate. The bottom plate formed with at least one auxiliary support piece forming line, wherein a starting point and an ending point of the auxiliary support piece forming line are unconnected, and the bottom plate is formed with at least one auxiliary support piece based on the at least one auxiliary support piece forming line, and each auxiliary support piece comprises a support part bent relative to the bottom plate and a bonding plate bent relative to the support part. The first wall plate is connected with one side of the bottom plate and bent relative to the bottom plate. The second wall plate is parallel to the first wall plate. In addition, two sides of the panel are respectively connected with the second wall plate and the first wall plate. The panel, the first wall plate, the second wall plate and the bottom plate form a tubular structure, and one side of the panel facing the bottom plate is provided with the bonding plate to be adhered so as to enable the at least one auxiliary support piece to stand in the tubular structure, the panel is formed with at least two handle forming lines symmetrically disposed, and a starting point and an ending point of each handle forming line are unconnected. The panel is formed with at least two cup receiving inlets when two handles are formed from the panel based on the at least two handle forming lines, and wherein the tubular structure is provided with a central axis connecting two tube orifices, and a long side of each handle is perpendicular to the central axis. The joint plate integrally extends from one of the second wall plate and the bottom plate, and the joint plate joined with one of the second wall plate and the bottom plate.

In an embodiment, the panel is formed with a perforation forming line at locations where the two handles are predetermined to be formed, respectively.

In an embodiment, the panel is formed with two symmetrically disposed sets of handle forming lines and at least two cup receiving inlet forming lines, each set of handle forming lines comprises an outer cutting line and an inner cutting line facing the other set of handle forming lines, and a starting point and an ending point of each of the cup receiving inlet forming lines are located on the inner cutting line, and two hollowed areas are formed on the panel when the two handles are formed from the panel based on the two sets of handle forming lines, and the two hollowed areas respectively form one of the at least two cup receiving inlets together with at least one of the cup receiving inlet forming lines.

In an embodiment, the outer cutting line comprises two linear segments disposed at intervals and a continuous curve segment, wherein two ends of the continuous curve segment are respectively connected with the two linear segments.

In an embodiment, the bottom plate is formed with a through hole when the at least one auxiliary support piece is formed, the joint plate extends from the second wall plate and is connected with the bottom plate, the joint plate holds the bottom plate, and the joint plate partially covers with the through hole.

Accordingly, compared with conventional technology, the invention has the following characteristics. The starting point and the ending point of at least one of the cup receiving inlet forming lines are located on the inner cutting line, so that the panel can directly form a plurality of cup receiving inlets when the two handles are formed. Also, the panel of the invention does not need to provide additionally structure to form the plurality of cup receiving inlets, so that the panel can be maximally utilized to form the plurality of cup receiving inlets, s the volume requirement of the seller in the transportation or display process can be simultaneously considered, and the space waste is reduced.

DETAILED DESCRIPTION OF THE PREFERRED EMBODIMENTS

Figure 1:
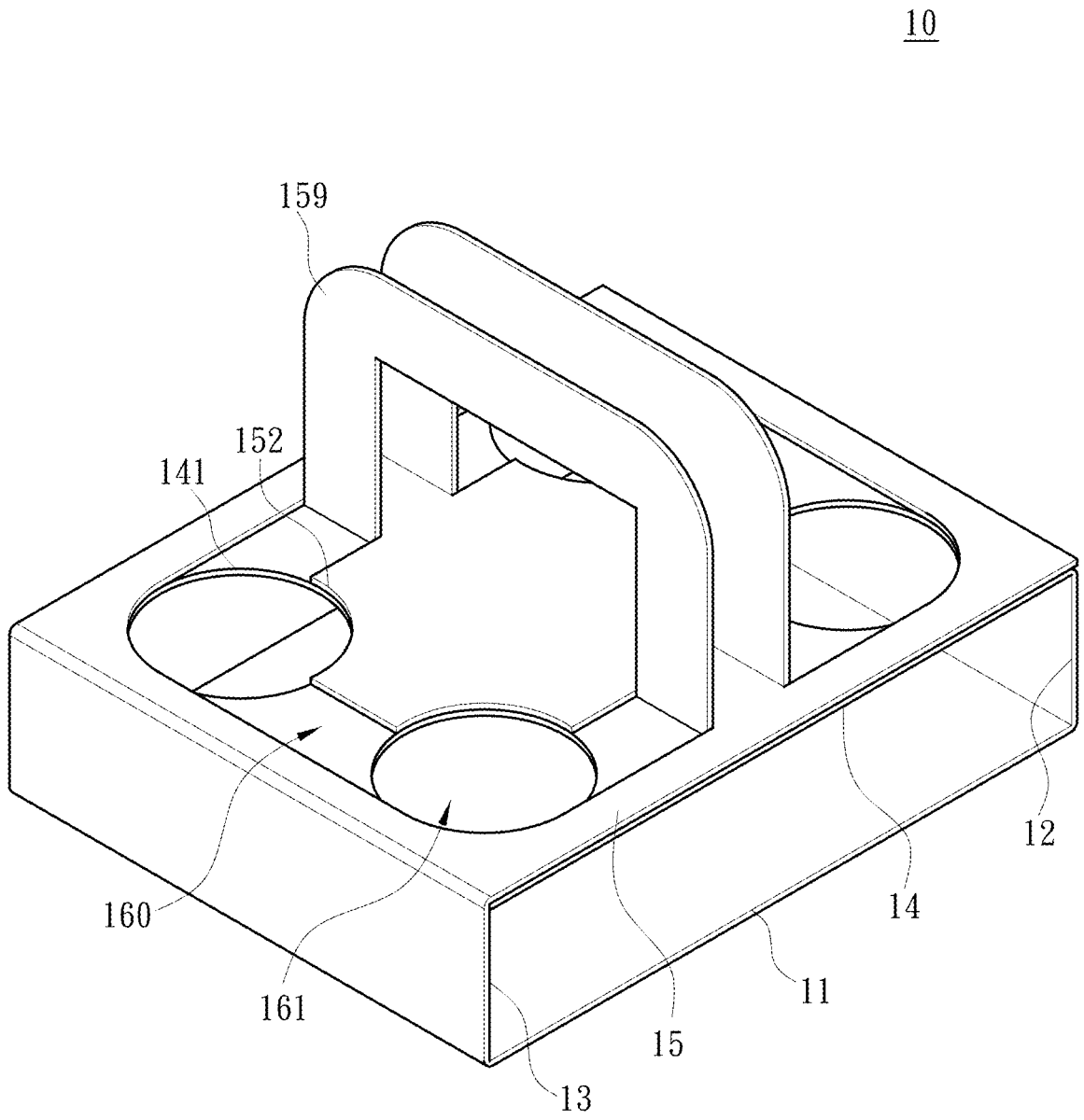
FIG. 1 is a first schematic perspective view according to a first embodiment of the present invention.
Figure 2:
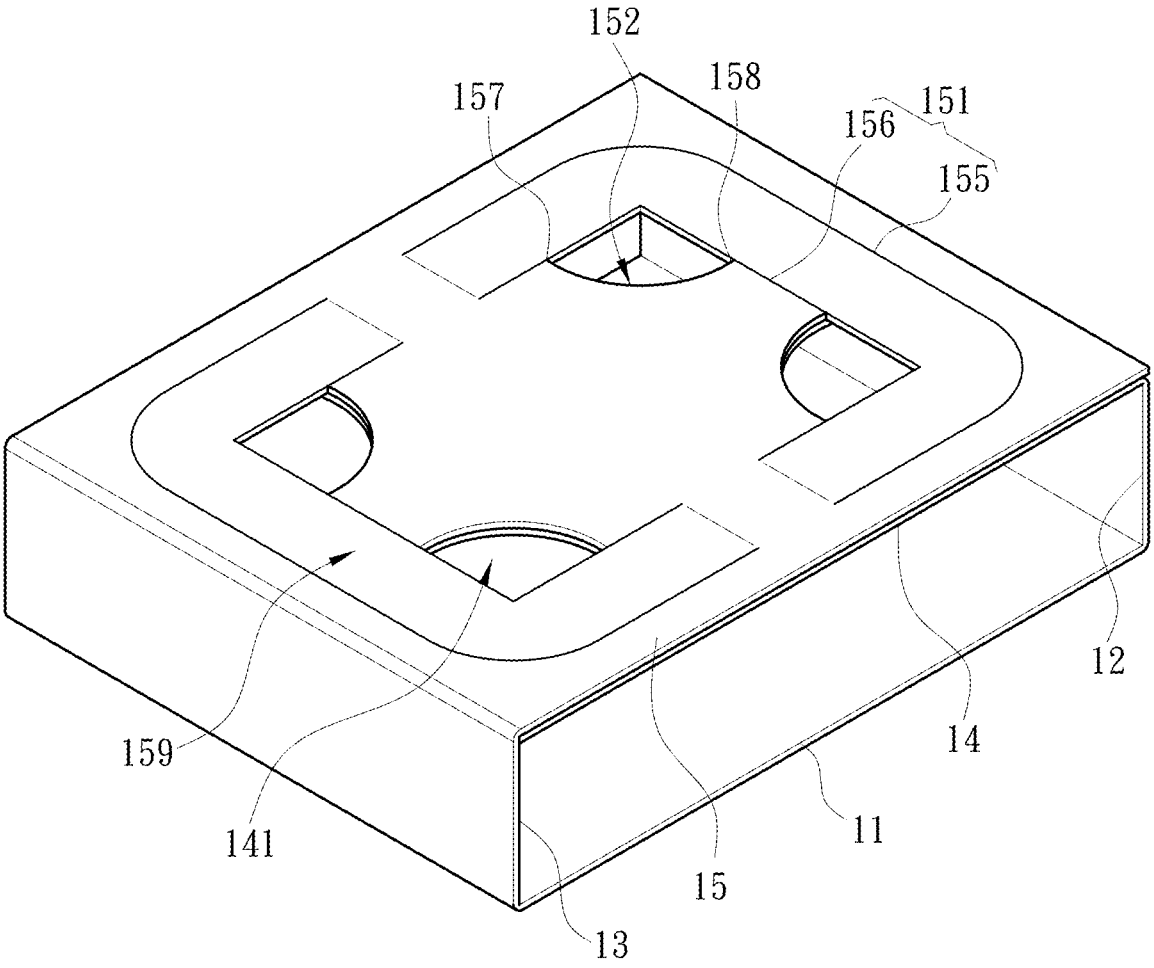
FIG. 2 is a second schematic perspective view according to the first embodiment of the present invention.

The detailed description and technical contents of the present invention will now be described with reference to the drawings as follows.

Referring to FIG. 1, FIG. 2, FIG. 3, FIG. 4 and FIG. 5, the present invention provides a paper cup-holder 10 that may be made of a paper plate with high hardness. In an embodiment, the paper plate is made of a corrugated paper. Further, the paper cup-holder 10 comprises a bottom plate 11, a first wall plate 12, a second wall plate 13, and a support plate 14 and a panel 15. Specifically, the first wall plate 12 integrally extends from a side of the bottom plate 11 and is bent relative to the bottom plate 11, the second wall plate 13 integrally extends from a side of the bottom plate 11 where the first wall plate 12 is not provided, and the second wall plate 13 is likewise bent relative to the bottom plate 11. In addition, the support plate 14 integrally extends from the first wall plate 12 and is bent relative to the first wall plate 12, the support plate 14 is parallel to the bottom plate 11 after being bent, wherein a distance between the support plate 14 being bent and the bottom plate 11 is determined by a height of the first wall plate 12. The panel 15 integrally extends from the second wall plate 13 and is bent relative to the second wall plate 13, the panel 15 is superposed and fixed on the support plate 14 after being bent. A method of fixing the panel 15 described herein can be done by nailing or adhesive. In an embodiment, the panel 15 is adhered on the support plate 14 by an adhesive.

Referring to FIG. 1, FIG. 2, FIG. 3, FIG. 4 and FIG. 5, the support plate 14 is formed with at least one opening 141, and the panel 15 is formed with two symmetrically disposed sets of handle forming lines 151 and at least two cup receiving inlet forming lines 152. Further, a centerline 153 is defined on the panel 15 and divides the panel 15 into two sections 154 that are respectively provided for one of the two sets of handle forming lines 151 and at least one of the cup receiving inlet forming line 152. In other words, the two sections 154 of the panel 15 divided by the centerline 153 are symmetrical with each other. Further, each of the two sets of handle forming lines 151 includes an outer cutting line 155, an inner cutting line 156 facing the other set of handle forming lines 151, wherein a starting point (e.g., 157) and an ending point (e.g., 158) of the at least one cup receiving inlet forming lines 152 are located on the inner cutting line 156. The panel 15 is formed with two hollowed areas 160 thereon when two sets of handle forming lines 151 are respectively formed into two handles 159, and each of the two hollowed areas 160 and the at least one of the cup receiving inlet forming lines 152 form a cup receiving inlet 161 corresponding to the at least one opening 141. Namely, a part of the cup receiving inlet 161 is formed by one of the two hollowed areas 160, and the other part of the cup receiving inlet 161 is surrounded by the at least two cup receiving inlet forming lines 152 and one of the two handles 159 which is not bent.

Accordingly, the paper cup-holder 10 of the present invention provides at least one cup for placing. The at least one cup is directly placed in the cup receiving inlet 161, and the two handles 159 allow a user to easily pick up the paper cup-holder 10. Compared with the prior art, the starting point and the ending point of each of the at least two cup receiving inlet forming lines 152 are located on the inner cutting line 156, a plurality of cup receiving inlets 161 are directly formed while the two handles 159 are formed on the panel 15. In other words, the panel 15 does not need to additionally provide with the plurality of cup receiving inlets 161, so that the plurality of cup receiving inlets 161 can maximally utilize the panel 15, the volume requirement of sellers can be simultaneously considered in the transportation or display process, and the space waste is reduced.

Figure 3:
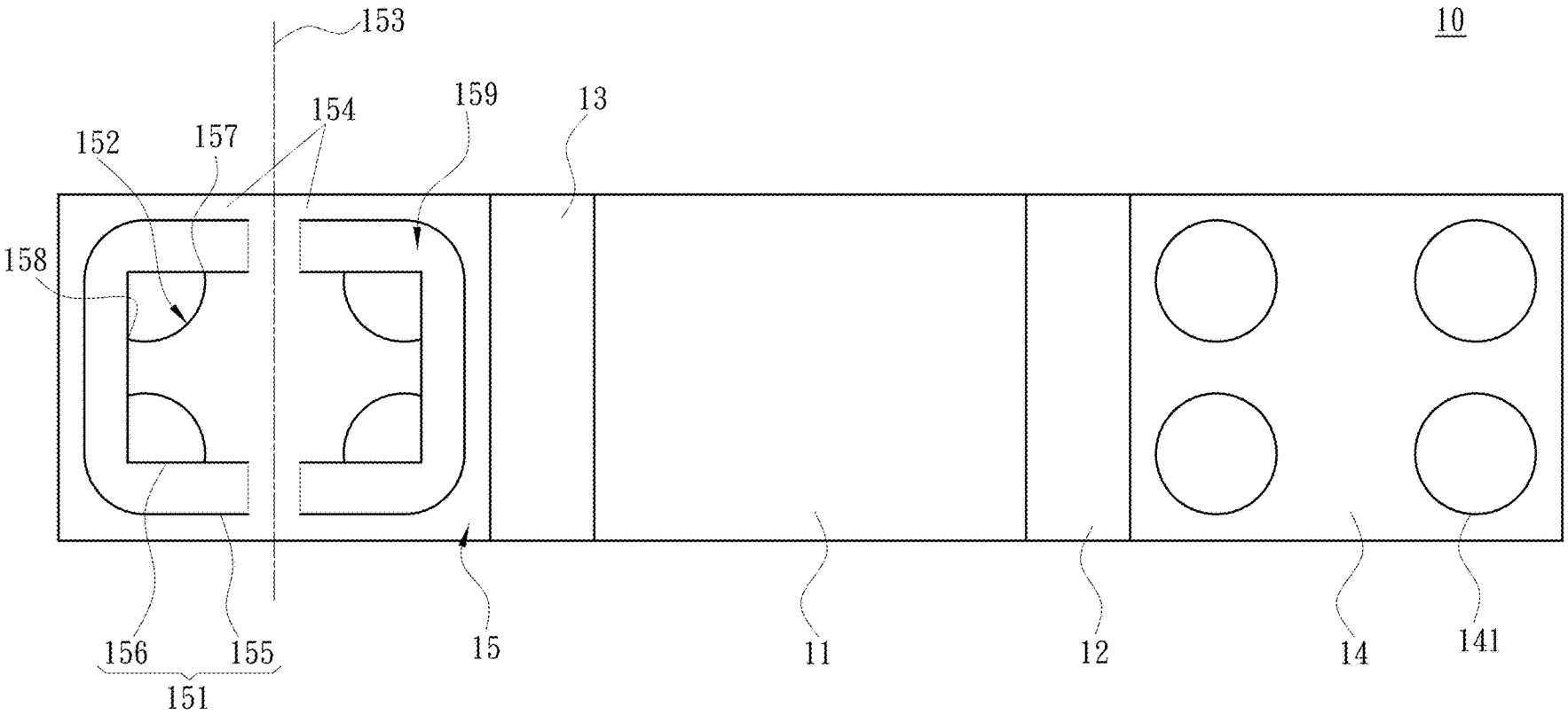
FIG. 3 is a schematic view of unfolding of a paper plate according to the first embodiment of the invention.
Figure 4:
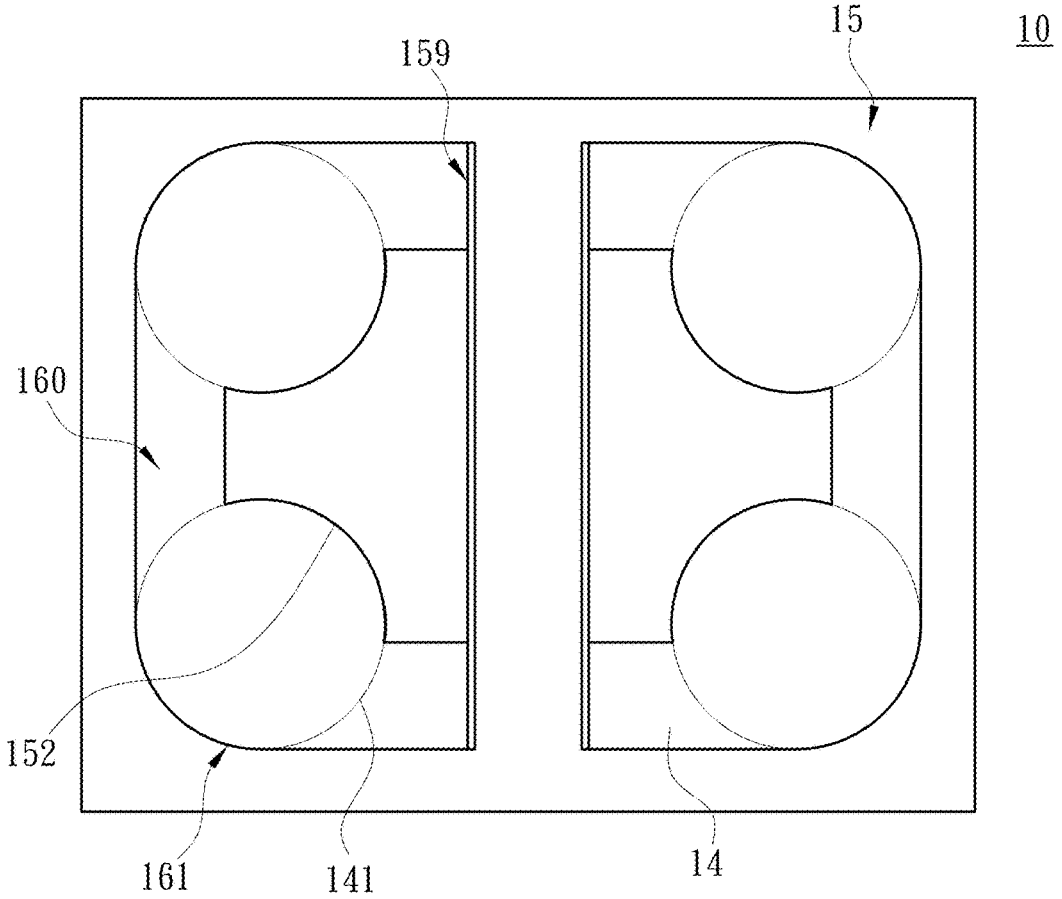
FIG. 4 is a schematic top view of the first embodiment of the present invention.
Figure 5:
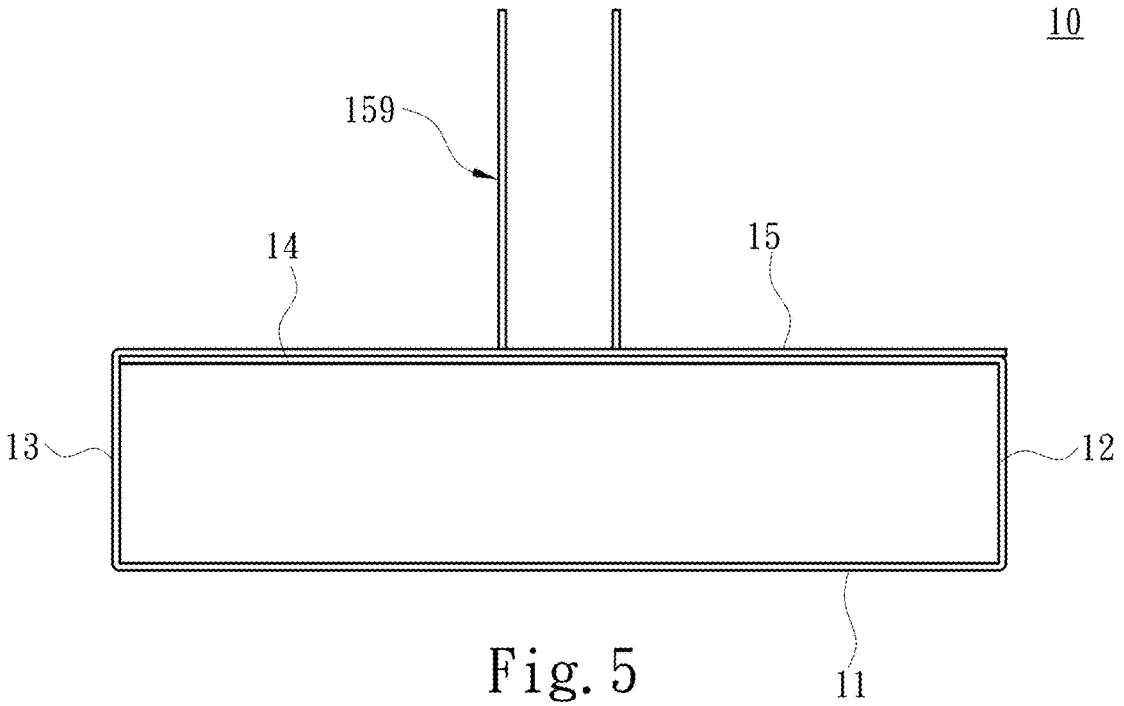
FIG. 5 is a schematic side view of the first embodiment of the present invention.
Figure 6:
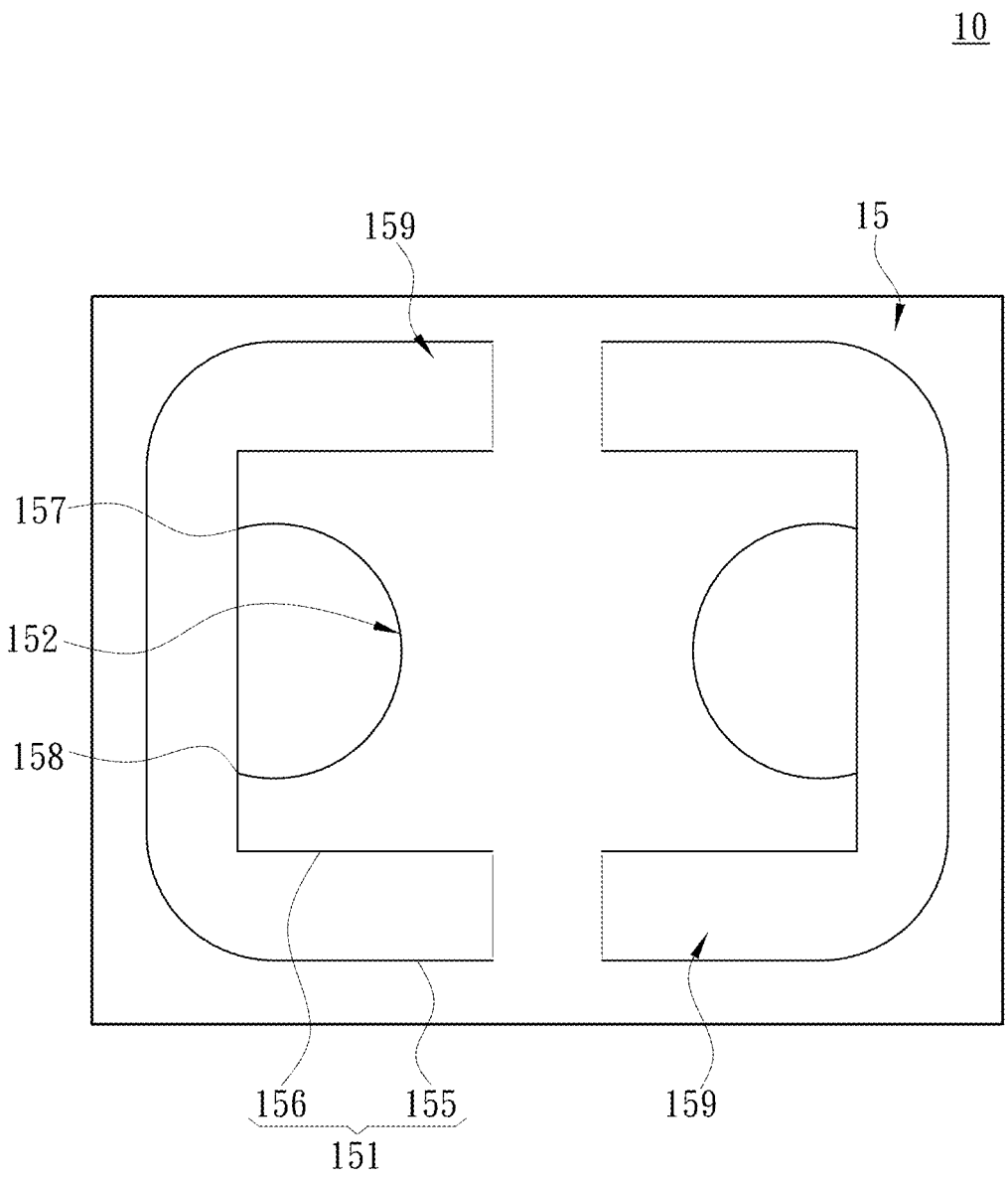
FIG. 6 is a schematic top view of a second embodiment of the present invention.
Figure 7:
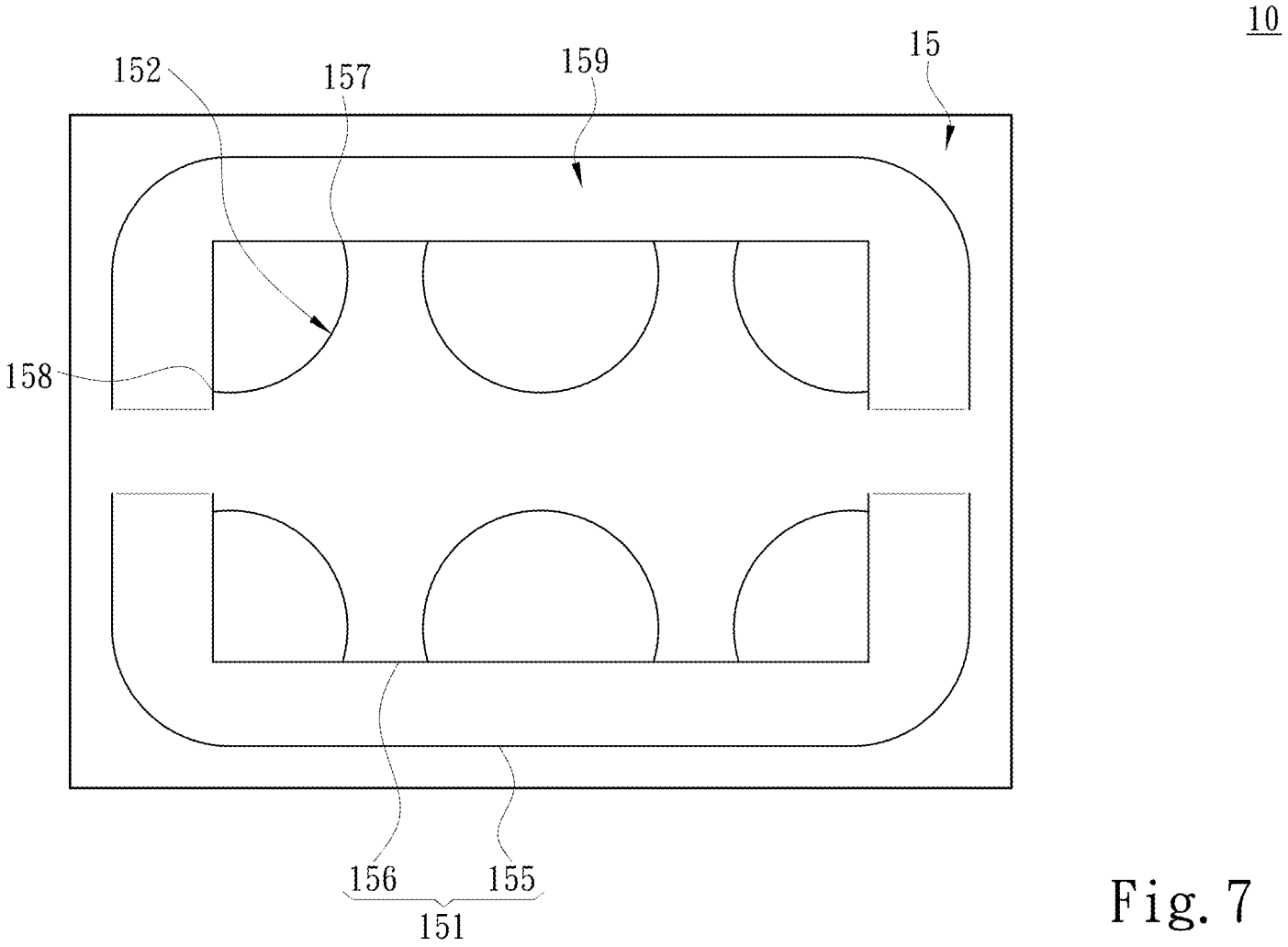
FIG. 7 is a schematic top view of a third embodiment of the present invention.

In an embodiment, referring to FIG. 3 and FIG. 4, each of the at least two cup receiving inlet forming lines 152 of the present invention is a cutting line, i.e. the plurality of cup receiving inlets 161 of the panel 15 are formed on the two hollowed areas 160 while the two handles 159 are formed on the panel 15. In another embodiment, each of the at least two cup receiving inlet forming lines 152 is configured in an arc shape which size is designed to fit the cup. In another embodiment, each of the at least two cup receiving inlet forming lines 152 is comprised of two line segments (not shown), one of the two line segments extends from the starting point 157 towards a direction which is opposite to the handle 159, the other of the two line segments extends from the ending point 158 towards a direction which is opposite to the handle 159, and the two line segments are connected at a side where the starting point 157 and the ending point 158 are not provided, and an included angle greater than or equal to 90 degrees is sandwiched between the two line segments. On the other hand, referring to FIG. 4, FIG. 6 and FIG. 7, a quantity of the at least two cup receiving inlet forming lines 152 are two or four or six, the two hollowed areas 160 form the plurality of cup receiving inlets 161 with the at least two cup receiving inlet forming lines 152 while the two handles 159 are formed on the panel 15. Also, in an embodiment, the at least two cup receiving inlet forming lines 152 are respectively and equally provided in the two sections 154 of the panel 15. That is, the at least one of the cup receiving inlet forming lines 152 facing each cutting lines has an equal number.

Figure 8:
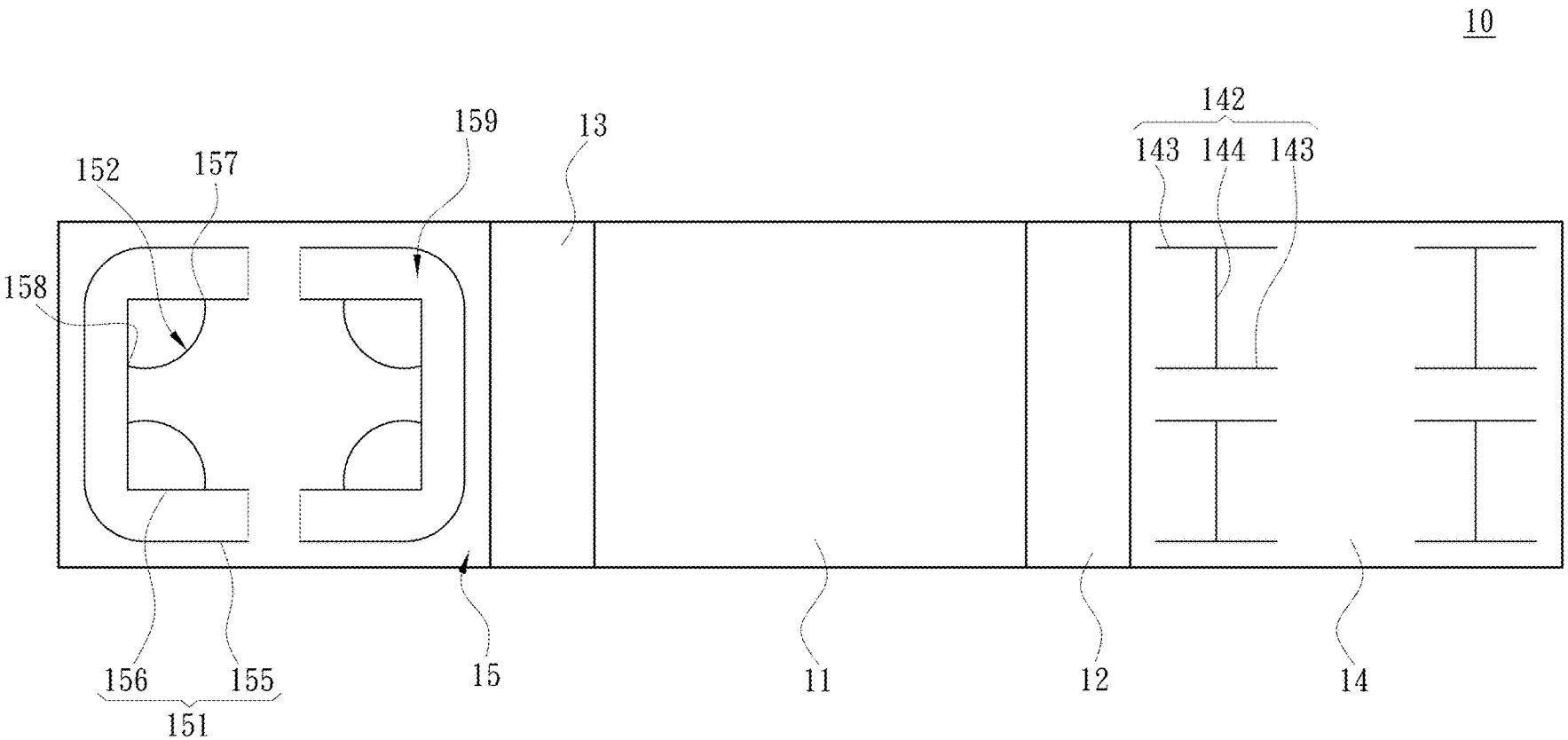
FIG. 8 is a schematic view of unfolding of a paper plate according to a fourth embodiment of the invention.

In an embodiment, the support plate 14 is formed with a plurality of openings 141 when the plurality of cup receiving inlets 161 are formed in the panel 15, and one of the plurality of openings 141 is disposed correspondingly to one of the plurality of cup receiving inlets 161. Referring to FIG. 8, in an embodiment, the support plate 14 includes a plurality of opening forming lines 142 for forming each of the plurality of openings 141, and each of the plurality of opening forming lines 142 comprises two transverse cutting lines 143 spaced apart, and a longitudinal cutting line 144 connected with the two transverse cutting lines 143. Thereby, each of the plurality of openings 141 is formed by the two transverse cutting lines 143 and the longitudinal cutting lines 144. In this embodiment, the plurality of openings 141 is configured in a quadrangular shape.

Figure 9:
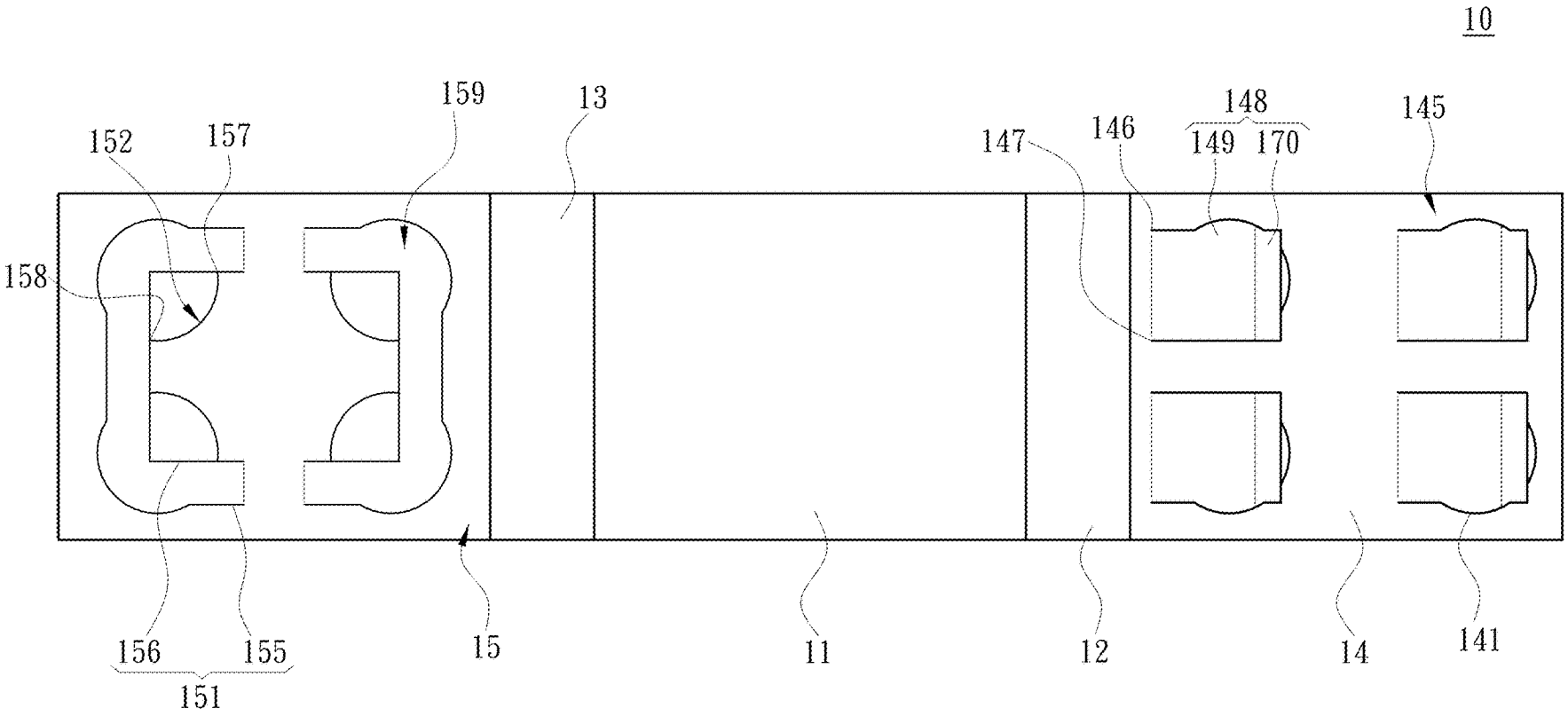
FIG. 9 is a schematic view of unfolding of a paper plate according to a fifth embodiment of the present invention.
Figure 10:
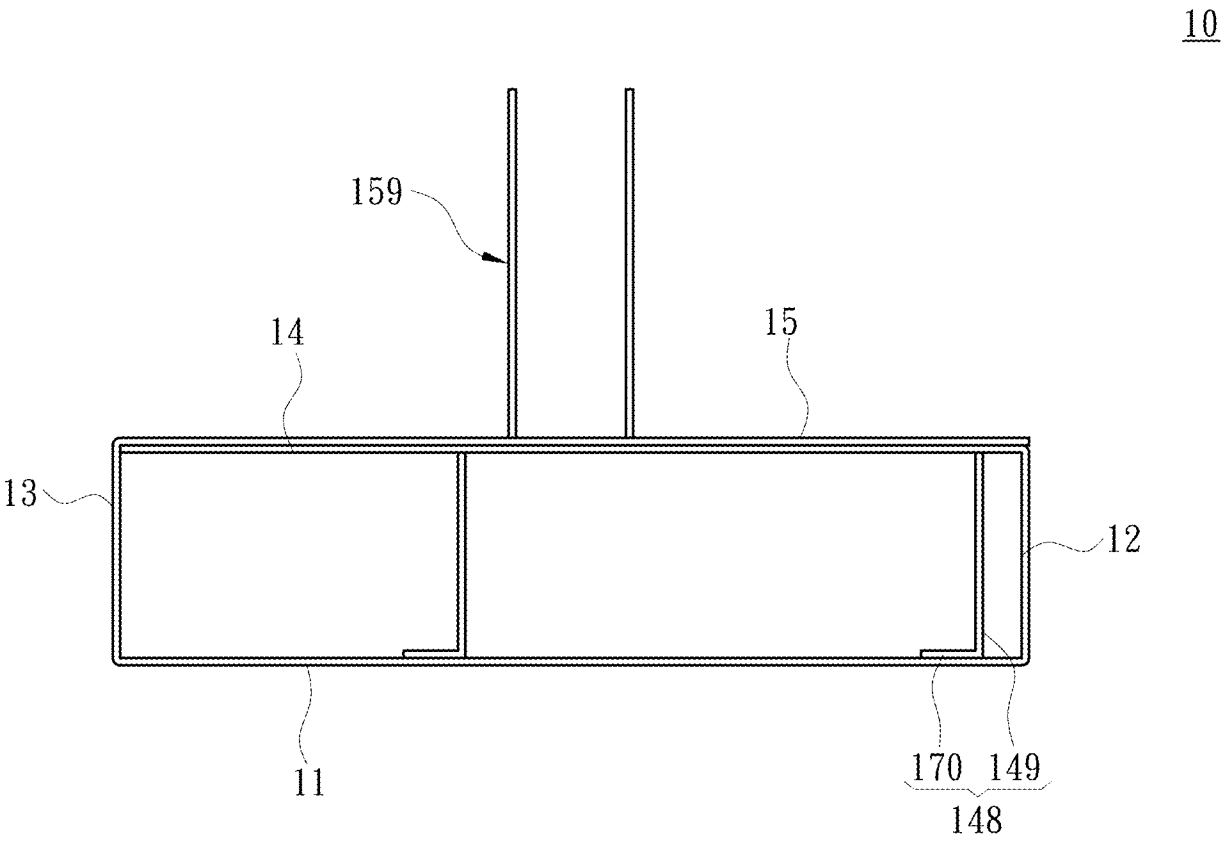
FIG. 10 is a schematic side view of the fifth embodiment of the present invention.

On the other hand, in an embodiment, please refer to FIG. 9 and FIG. 10. The support plate 14 includes at least one opening forming line 145 for forming at least one openings 141, a starting point 146 and an ending point 147 of the at least one opening forming line 145 are unconnected, and a first auxiliary support piece 148 is formed when the least one openings 141 is formed by the at least one opening forming line 145. The first auxiliary support piece 148 supports between the support plate 14 and the bottom plate 11 after being bent towards a direction facing the bottom plate 11, thereby providing a supporting effect. In addition, the first auxiliary support piece 148 comprises a first side plate 149 and a first bonding plate 170, wherein the first side plate 149 is bent towards a direction facing the bottom plate 11, and the first bonding plate 170 is connected with one side of the first side plate 149 where is adjacent to the bottom plate 11. The first bonding plate 170 is adhered to the bottom plate 11 after the first side plate 149 is bent towards the direction facing the bottom plate 11, so that the first auxiliary support piece 148 is limited in displacement. In the invention, the first bonding plate 170 can be adhered to the bottom plate 11 by glue or double-sides adhesive tapes, etc. Further, in an embodiment, the support plate 14 includes a plurality of opening forming lines 145 to form a plurality of openings 141, and a plurality of first auxiliary support pieces 148 is formed by bending the support plate 14 towards the same direction. In other words, the plurality of first auxiliary support pieces 148 is located on the same side of the plurality of openings 141, thereby preventing the paper cup-holder 10 from being unevenly received and facilitating storage.

Figure 11:
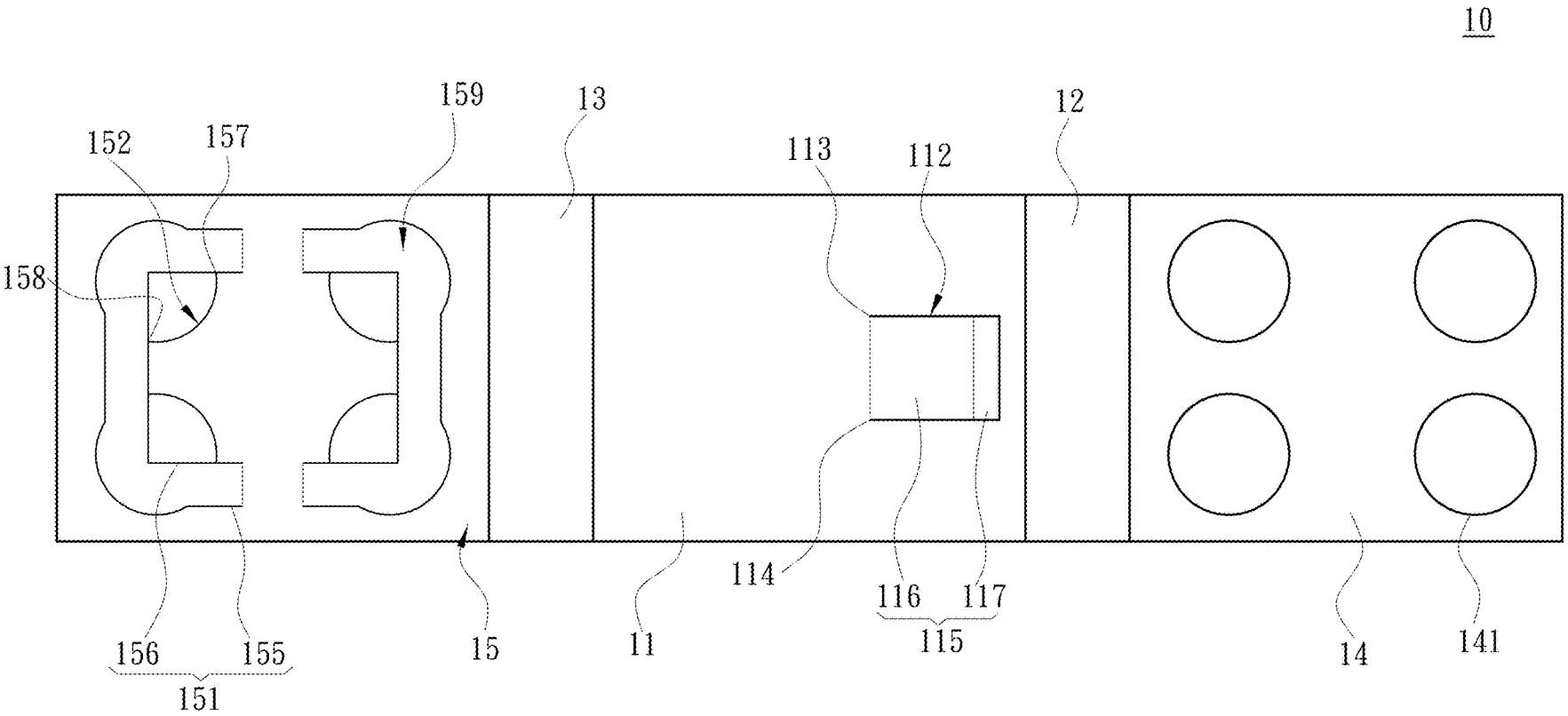
FIG. 11 is a schematic view of unfolding of a paper plate according to a sixth embodiment of the present invention.
Figure 12:
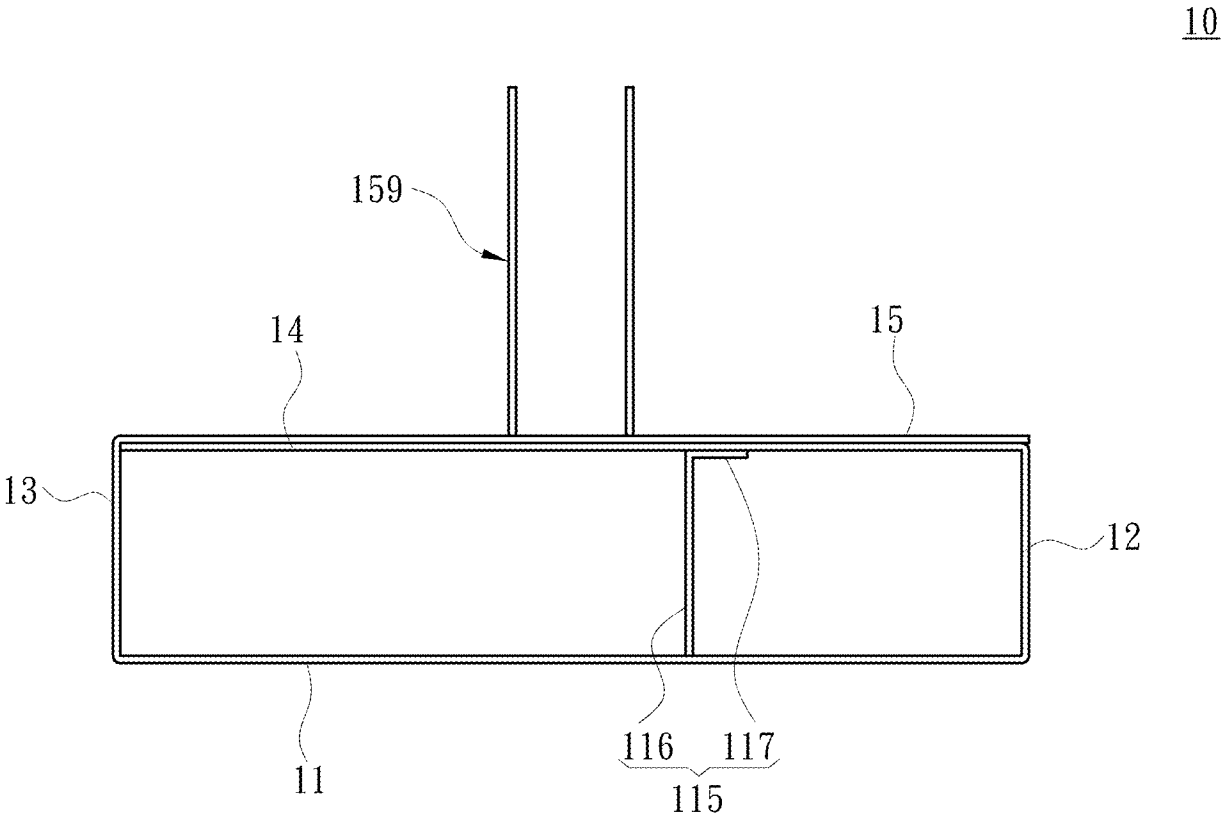
FIG. 12 is a schematic side view of the sixth embodiment of the present invention.
Figure 13:
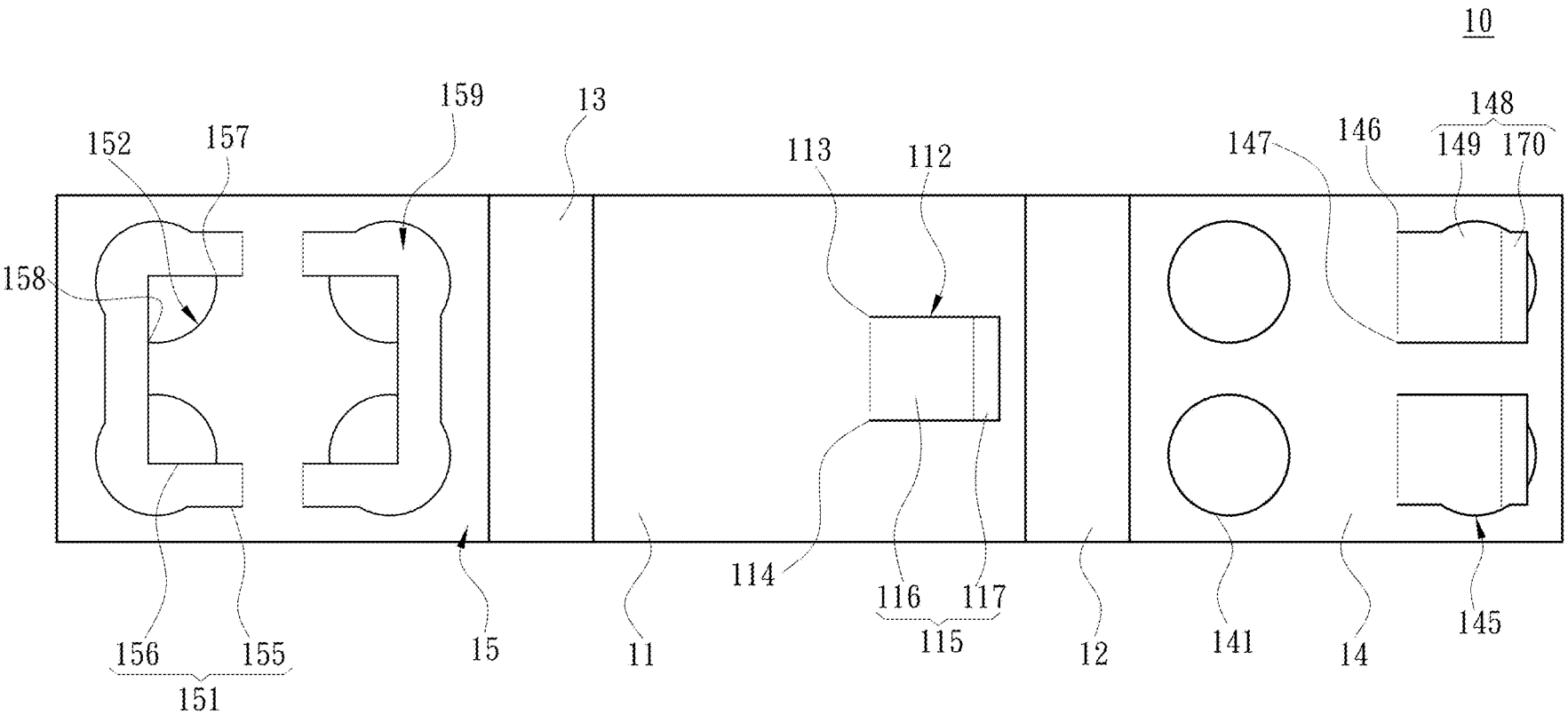
FIG. 13 is a schematic view of unfolding of a paper plate according to a seventh embodiment of the present invention.
Figure 14:
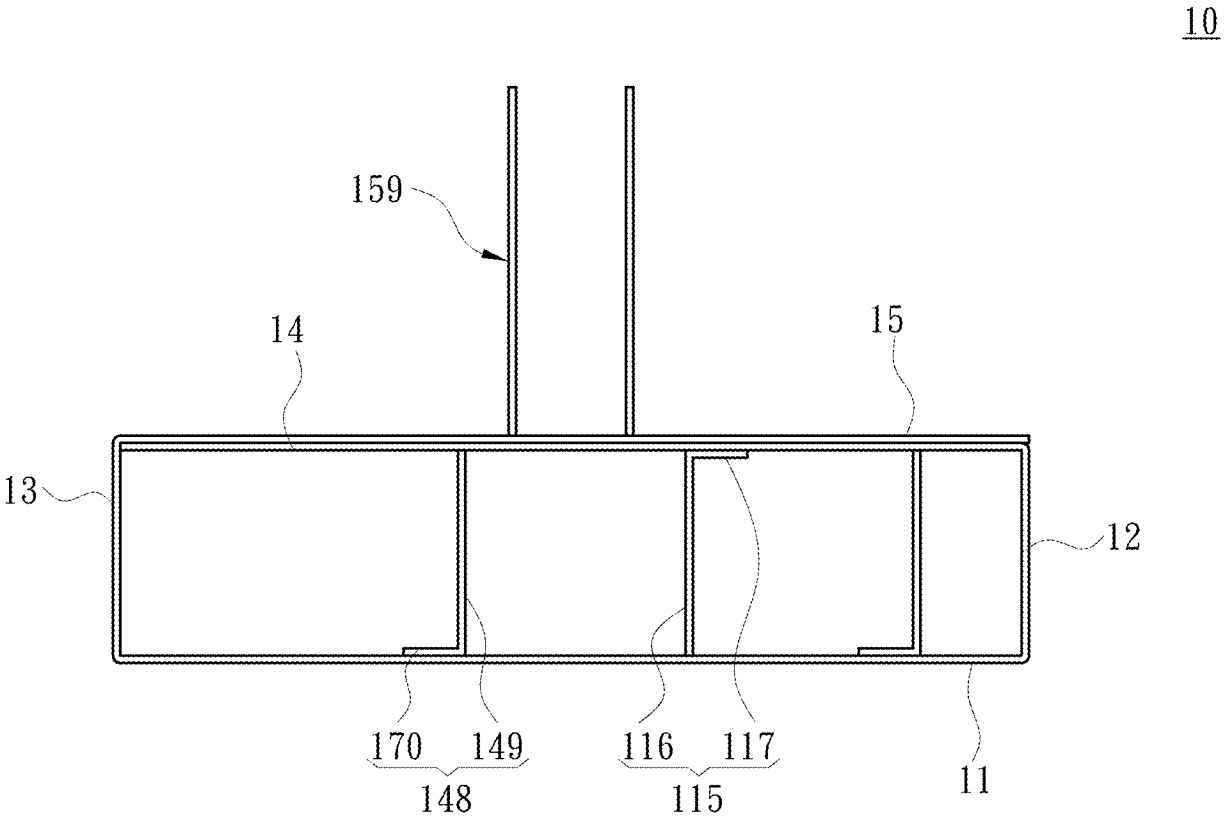
FIG. 14 is a schematic side view of the seventh embodiment of the present invention.

Further, in one embodiment, referring to FIG. 11 and FIG. 12, the bottom plate 11 comprises at least one auxiliary support piece forming line 112, wherein a starting point 113 and an ending point 114 of the at least one auxiliary support piece forming line 112 are unconnected; and a second auxiliary support piece 115 is formed from the bottom plate 11 based on the at least one auxiliary support piece forming line 112. After the second auxiliary support piece 115 is bent toward a direction facing the bottom plate 11, the second auxiliary support piece 115 supports between the bottom plate 11 and the support plate 14, thereby providing a supporting effect. In addition, the second auxiliary support piece 115 comprises a second side plate 116 and a second bonding plate 117, wherein the second side plate 116 is bent towards a direction facing the support plate 14, the second bonding plate 117 is connected with one side of the second side plate 116 where is adjacent to the support plate 14, and the second bonding plate 117 can be adhered to the support plate 14 by glue or double faced adhesive tapes or the like after the second bonding plate 117 is bent towards the direction facing the support plate 14, so that the second auxiliary support piece 115 is limited in displacement. Further referring to FIG. 13 and FIG. 14, in an embodiment, the first auxiliary support piece 148 is formed on the support plate 14 and the bottom plate 11 is formed with the second auxiliary support piece 115. That is, the paper cup-holder 10 increases the support stability by the second auxiliary support piece 115 and the first auxiliary support piece 148.

Figure 15:
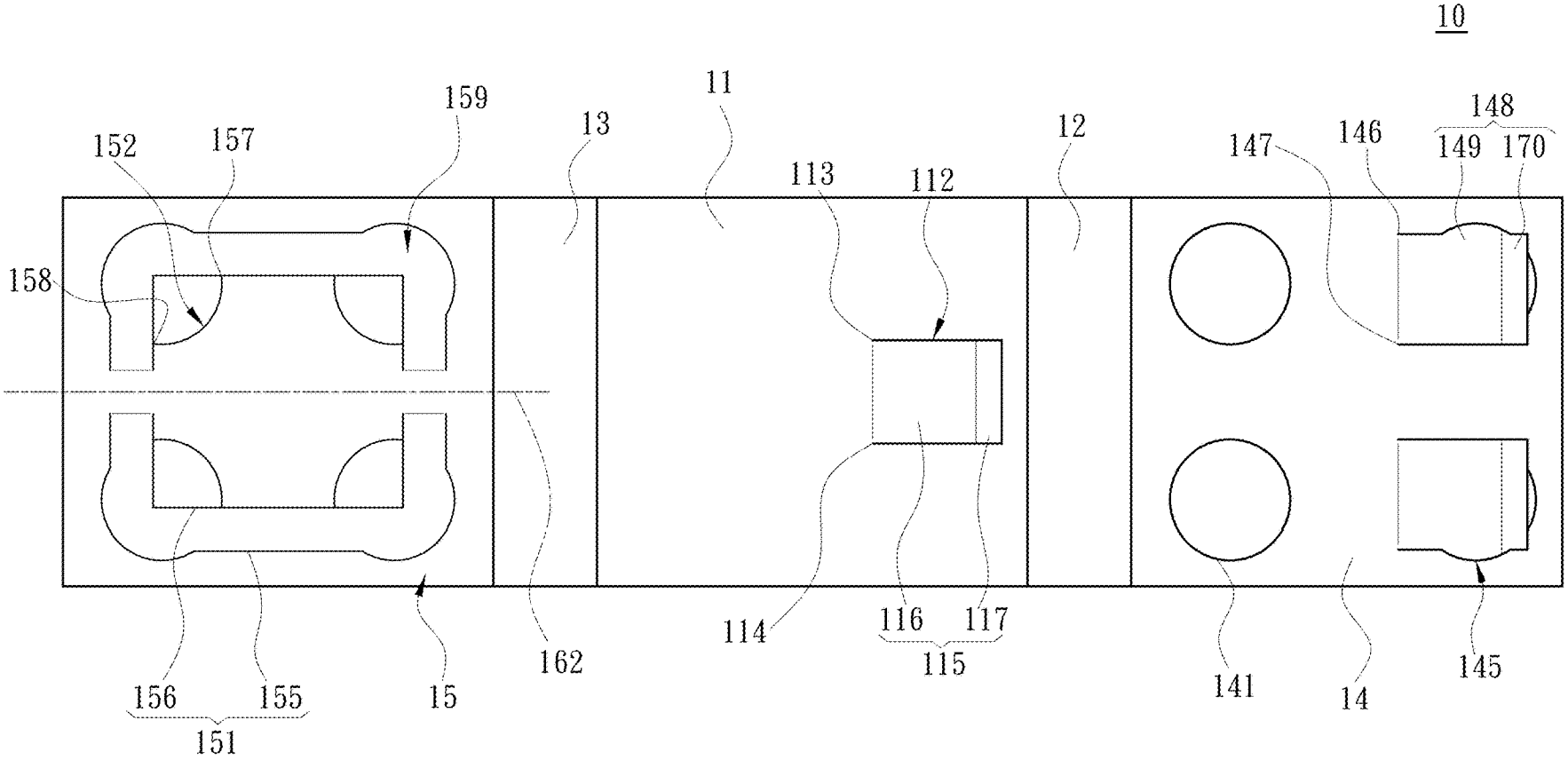
FIG. 15 is a schematic view of unfolding of a paper plate according to an eighth embodiment of the present invention.
Figure 16:
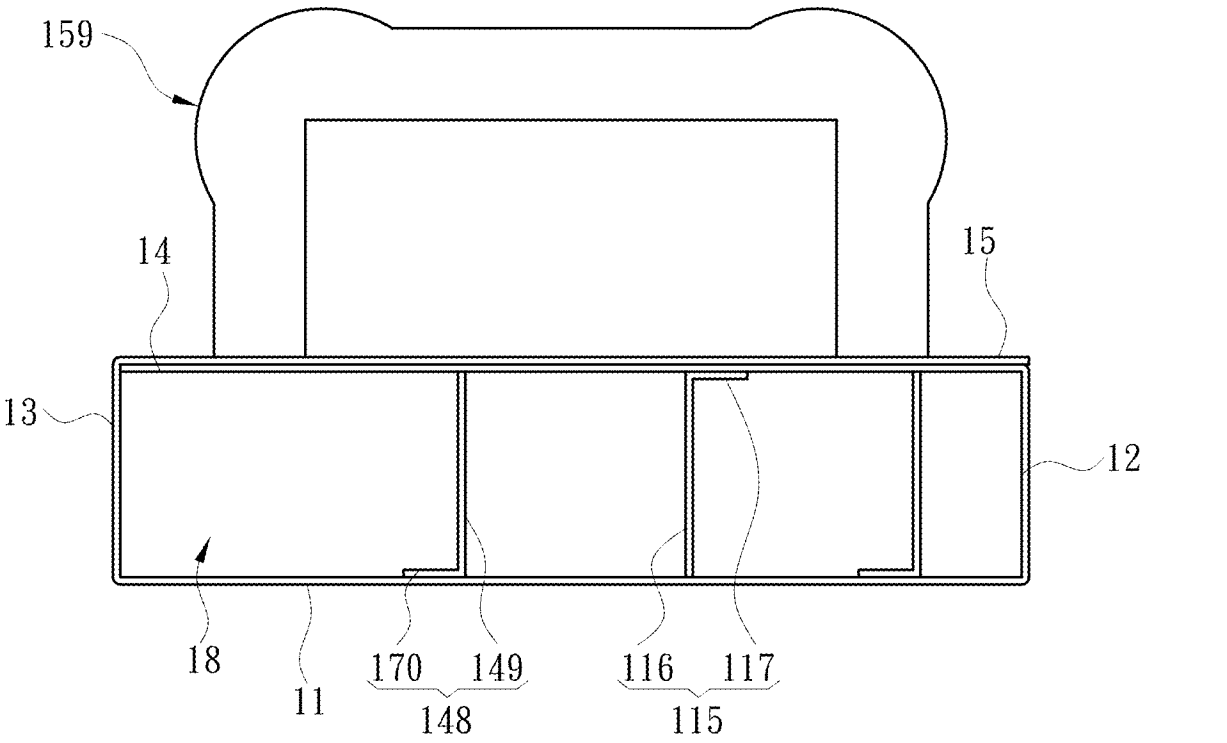
FIG. 16 is a schematic side view of the eighth embodiment of the present invention.
Figure 17:
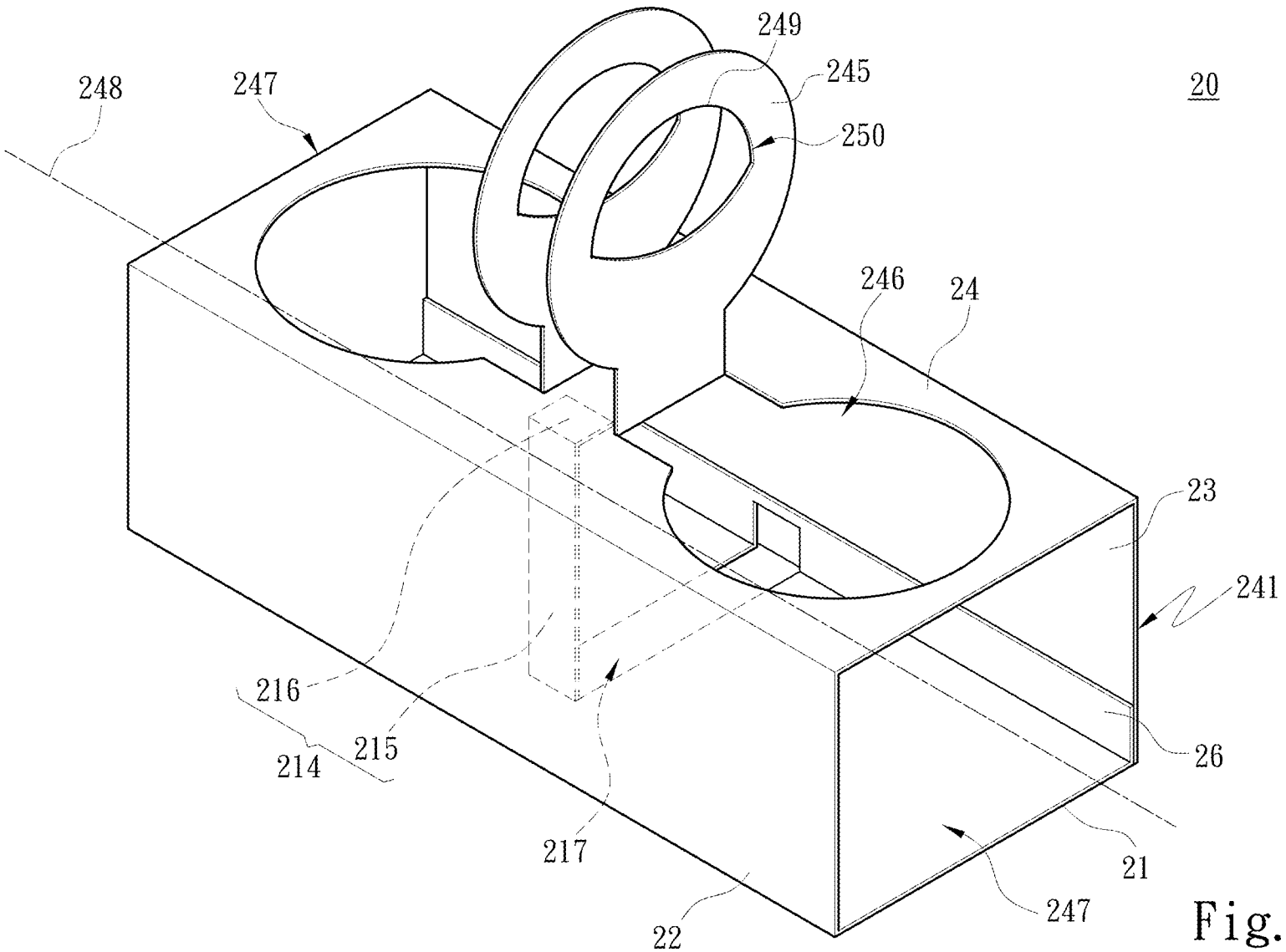
FIG. 17 is a schematic perspective view according to a ninth embodiment of the present invention.
Figure 18:
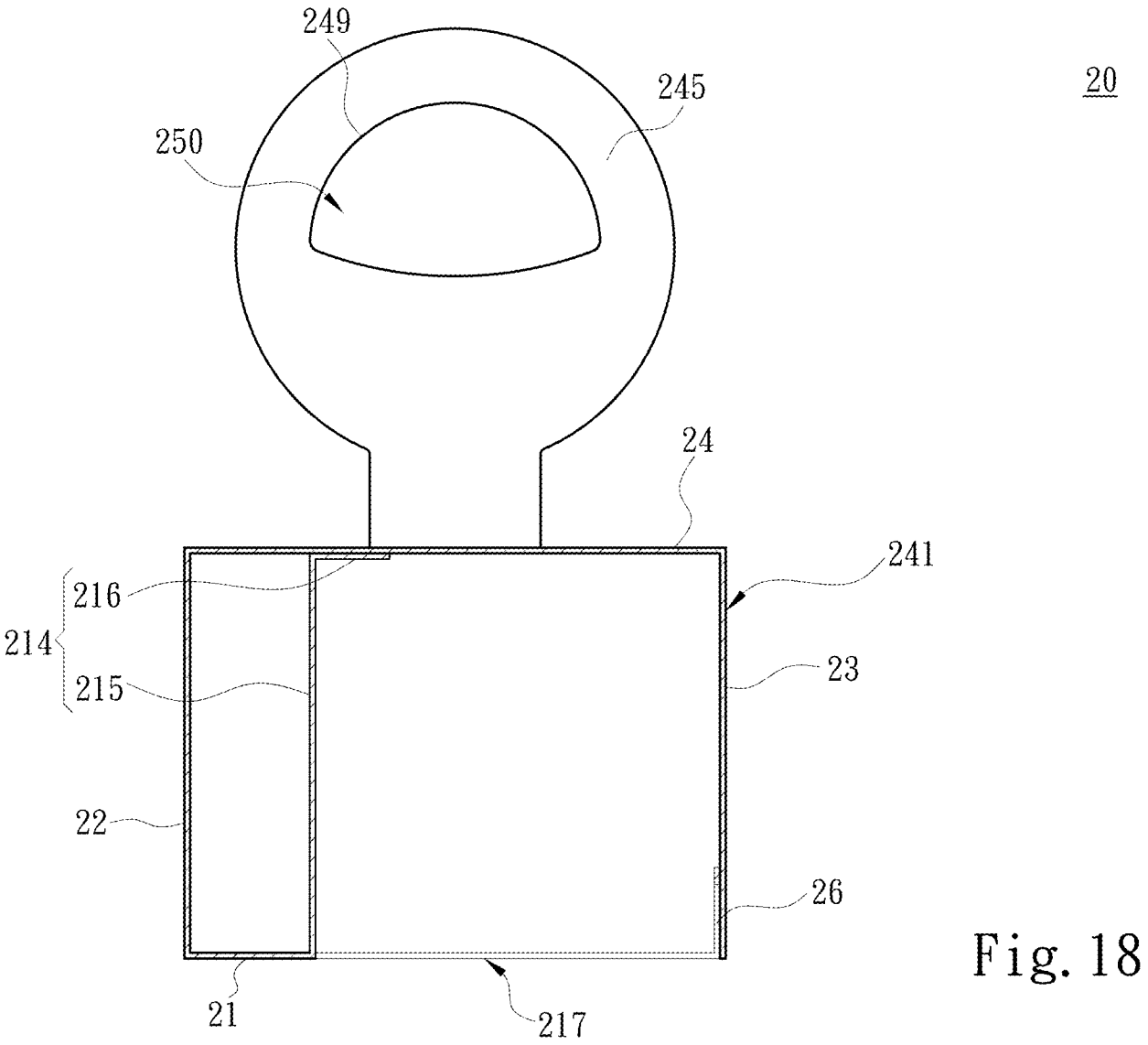
FIG. 18 is a schematic side view of the ninth embodiment of the present invention.

On the other hand, referring to FIG. 15 and FIG. 16, in an embodiment, the panel 15 defines an extension line 162 extending in an arrangement direction of the second wall plate 13, the bottom plate 11, the first wall plate 12 and the support plate 14, and the long sides of the two handles 159 are arranged parallel to the extension line 162. Further, as shown in FIG. 16, the paper cup-holder 10 includes a through hole 18 defined by the bottom plate 11, the first wall plate 12, the second wall plate 13, the support plate 14 and the panel 15 after being bent. Further, by viewing the two handles 159 in a direction facing the through hole 18 (i.e., the view depicting FIG. 16 herein), one of the two handles 159 is obscured by the other of the two handles 159. The paper cup-holder 10 of this embodiment provides more stable placement for at least one beverage cup (not shown) when the two handles 159 are lifted.

Figure 19:
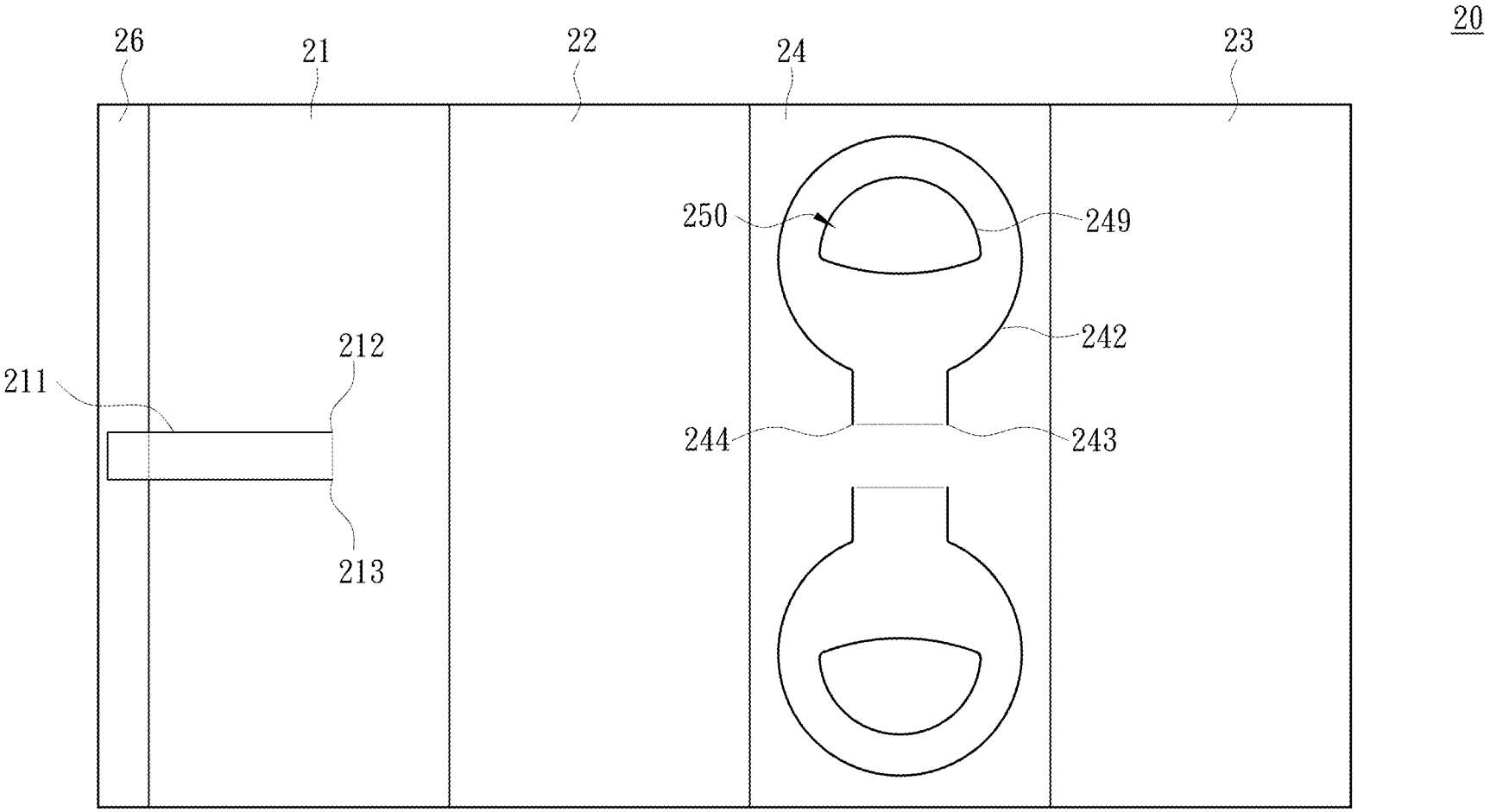
FIG. 19 is a schematic view of unfolding of a paper plate according to the ninth embodiment of the present invention.
Figure 20:
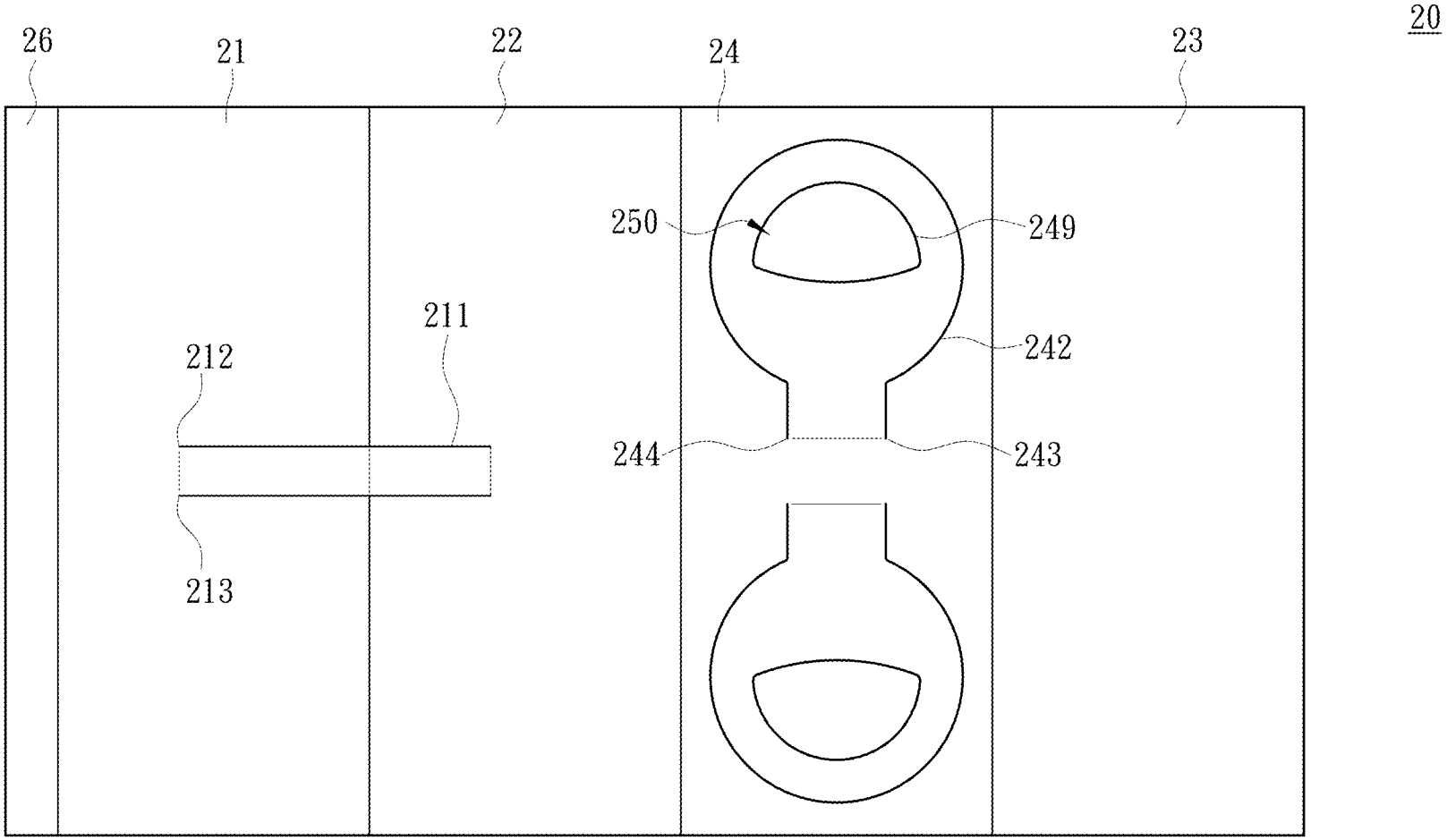
FIG. 20 is a schematic view of unfolding of a paper plate according to a tenth embodiment of the present invention.

In addition to the foregoing, referring to FIG. 17, FIG. 18, FIG. 19, FIG. 20, FIG. 21, FIG. 22 and FIG. 23, the present invention also provides a paper cup-holder 20 with high hardness. In an embodiment, the paper cup-holder 20 may be made of a corrugated paper or a thick paper plate. The paper cup-holder 20 comprises a bottom plate 21, a first wall plate 22, a second wall plate 23, a panel 24 and a joint plate 26, wherein the first wall plate 22 is connected with one side of the bottom plate 21 and is bent relative to the bottom plate 21, the first wall plate 22 is parallel to the second wall plate 23, and two sides of the panel 24 are respectively connected with the first wall plate 22 and the second wall plate 23. The joint plate 26 integrally extends from the second wall plate 23 or the bottom plate 21, and is joined with the second wall plate 23 or the bottom plate 21. Further, at least one auxiliary support piece forming line 211 is formed on the bottom plate 21, and a starting point (e.g., 212) and a ending point (e.g., 213) of the at least one auxiliary support piece forming line 211 are unconnected. At least one auxiliary support piece 214 is formed on the bottom plate 21 based on the at least one auxiliary support piece forming line 211. Each auxiliary support piece 214 comprises a support part 215 and a bonding plate 216, wherein the support part 215 integrally extends from the bottom plate 21 and is bent relative to the bottom plate 21, and the bonding plate 216 extends from the support part 215 and is bent relative to the support part 215. In an embodiment, the at least one auxiliary support piece forming line 211 is formed on the bottom plate 21 and the joint plate 26, as shown in FIG. 19. In another embodiment, the at least one auxiliary support piece forming line 211 is formed on the bottom plate 21 and the first wall plate 22, as shown in FIG. 20. Further, the panel 24 is bent relative to the first wall plate 22 and the second wall plate 23, so that the panel 24, the first wall plate 22, the second wall plate 23, and the bottom plate 21 form a tubular structure 241. A distance between the panel 24 and the bottom plate 21 is determined by heights of the first wall plate 22 and the second wall plate 23, one side of the panel 24 facing the bottom plate 21 is provided with the bonding plate 216 to be adhered so as to enable the at least one auxiliary support piece 214 to stand in the tubular structure 241, and the panel 24 is supported by the at least one auxiliary support piece 214 to maintain the distance between the panel 24 and the bottom plate 21. At least two handle forming lines 242 are formed on the panel 24 and are symmetrically disposed, wherein a starting point (e.g., 243) and an ending point (e.g., 244) of each of the at least two handle forming lines 242 are unconnected. When two handles 245 are formed from the panel 24 based on the at least two handle forming lines 242, the panel 24 is formed with at least two cup receiving inlets 246. The tubular structure 241 is provided with two tube orifices 247 and a central axis 248 connecting the two tube orifices 247, and a long side of each handle 245 is perpendicular to the central axis 248.

Accordingly, the present invention provides the at least two cup receiving inlets 246 which are simultaneously formed from the panel 24 when the two handles 245 are formed. Compared with the conventional art, the paper cup-holder 20 does not need to form the two handles 245 and the at least two cup receiving inlets 246 separately, so that the at least two cup receiving inlets 246 can be maximally utilized with the panel 24. Also, the volume requirement of a seller during transportation or display can be simultaneously satisfied, and the space waste is reduced.

Referring to FIG. 17, FIG. 18, FIG. 19 and FIG. 20, in an embodiment, the two cup receiving inlets 246 are formed in the panel 24 while the two handles 245 are formed from the panel 24 based on the at least two handle forming lines 242, and the panel 24 is formed with a perforation forming line 249 at locations where the two handles 245 are predetermined to be formed, respectively; and a perforation 250 is formed on the panel 24 based on the perforation forming line 249 to provide a user to grasp the two handles 245 when the user lifts the paper cup-holder 20. Further, in this embodiment, the joint plate 26 is connected to one side of the bottom plate 21 without extending to the first wall plate 22, and the joint plate 26 is joined with one side of the second wall plate 23 facing the first wall plate 22.

Figure 21:
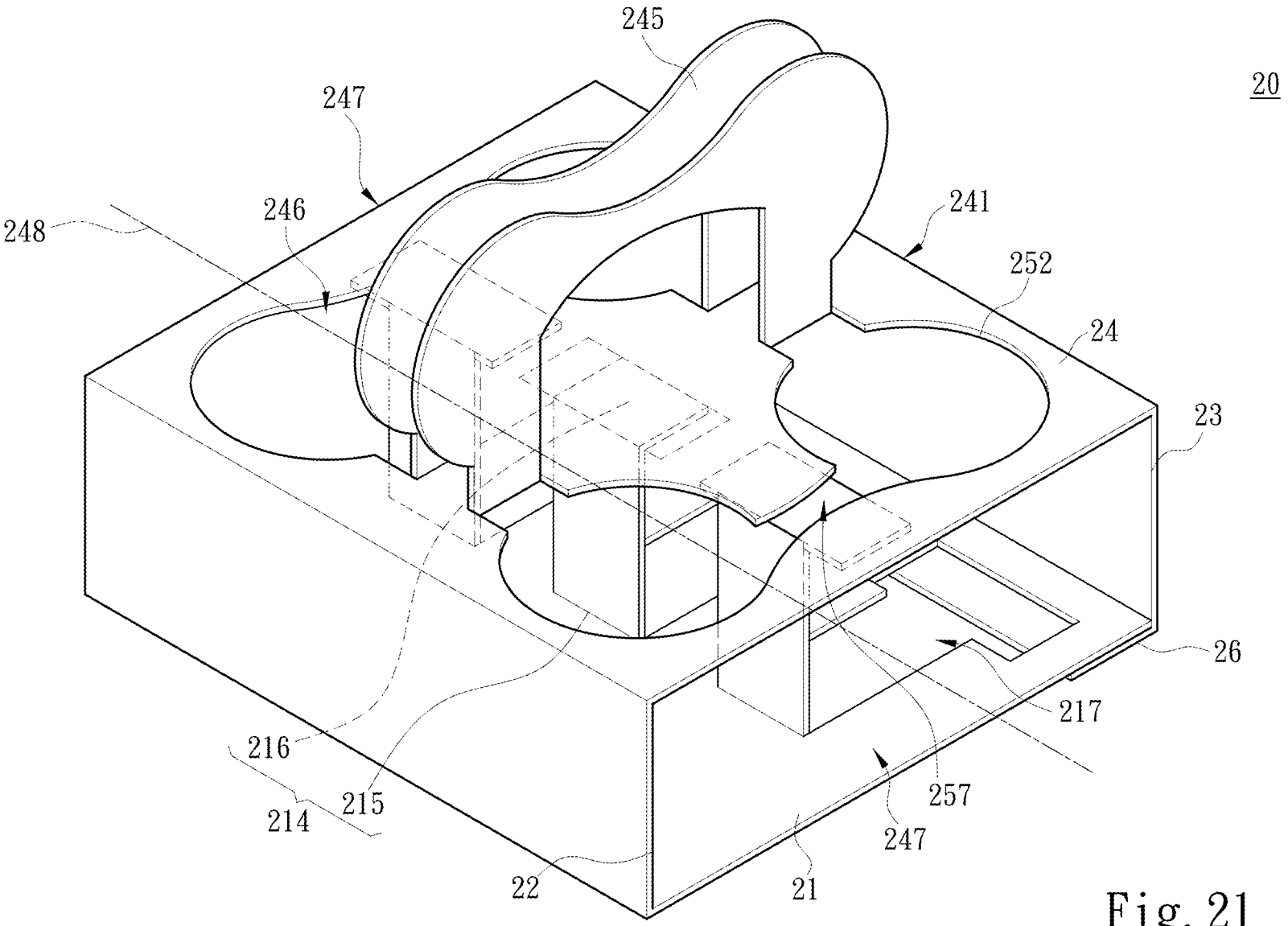
FIG. 21 is a schematic perspective view according to an eleventh embodiment of the present invention.
Figure 22:
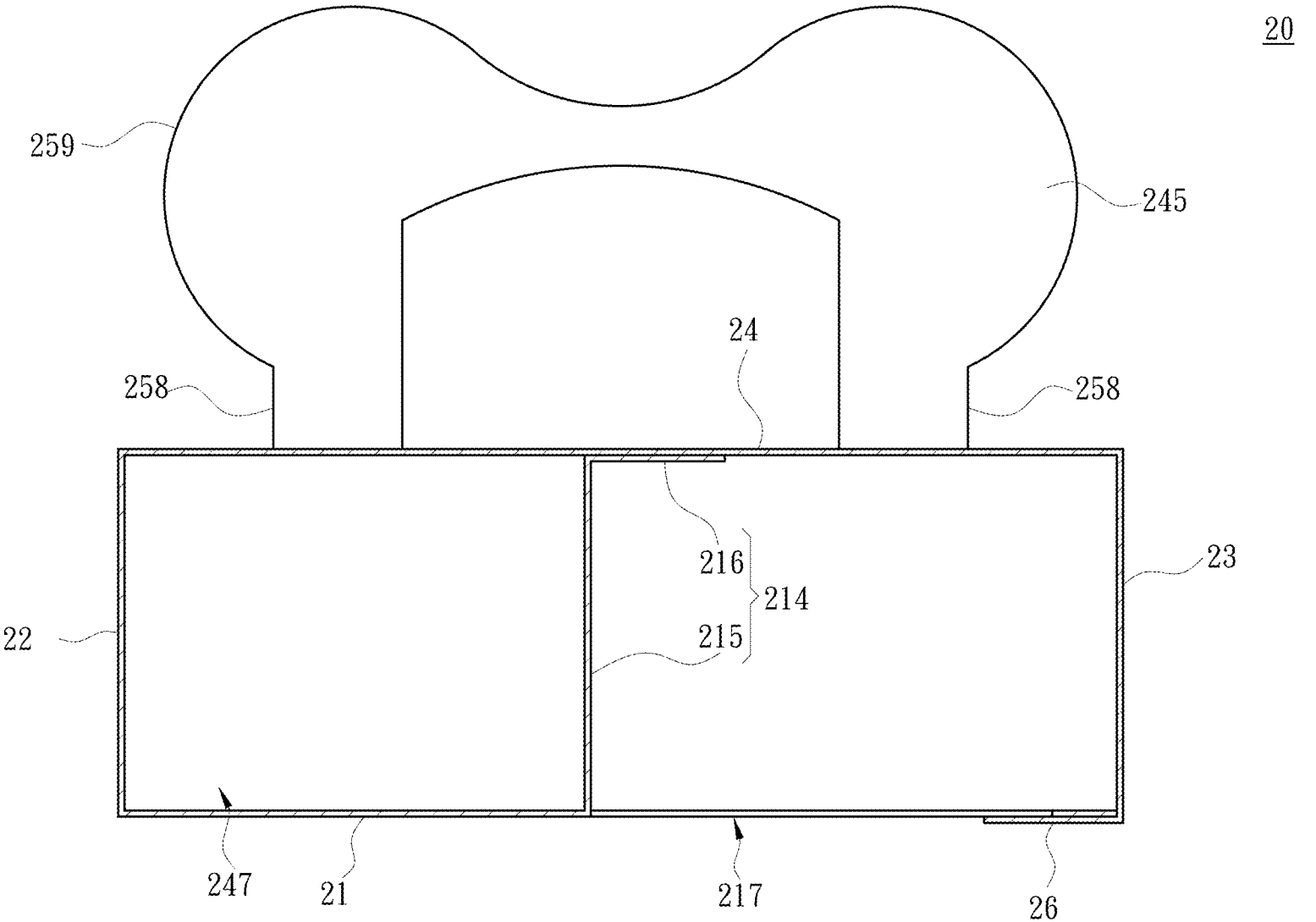
FIG. 22 is a schematic side view of the eleventh embodiment of the present invention.
Figure 23:
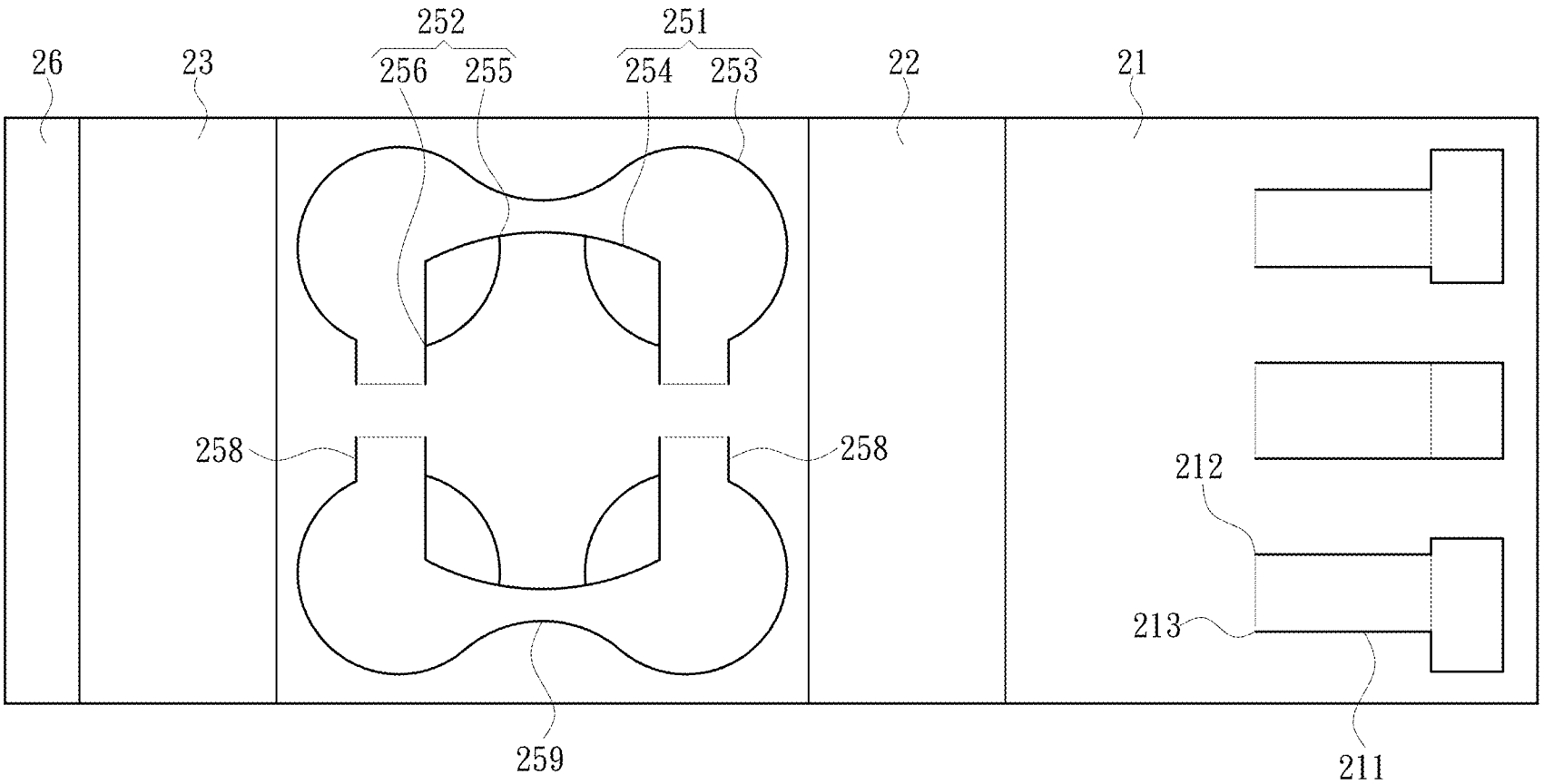
FIG. 23 is a schematic view of unfolding of a paper plate according to the eleventh embodiment of the invention.

Further, referring to FIG. 21, FIG. 22 and FIG. 23, in another embodiment, the panel 24 is formed with two symmetrically disposed sets of handle forming lines 251 and at least two cup receiving inlet forming lines 252. Each set of handle forming lines 251 includes an outer cutting line 253 and an inner cutting line 254 facing the other set of handle forming lines 251. At least one starting point (e.g., 255) and at least one ending point (e.g., 256) of the at least two cup receiving inlet forming lines 252 are located on the inner cutting line 254. Two hollowed areas 257 are formed when the panel 24 is bent based on the two sets of handle forming lines 251 to form the two handles 245 simultaneously. Each of the cup receiving inlets 246 is formed by the hollowed areas 257 and one of the cup receiving inlet forming lines 252, in this embodiment, four cup receiving inlets are formed. Further, the outer cutting line 253 comprises two linear segments 258 and a continuous curve segment 259, wherein the two linear segments 258 are arranged at intervals and are respectively connected to two ends of the continuous curve segment 259, and portion of the continuous curve segment 259 is designed to correspond to the user's gestures for holding the two handles 245, thereby lifting of the paper cup-holder 20 by the user is facilitated.

Further, referring to FIG. 21, FIG. 22 and FIG. 23, in an embodiment, the joint plate 26 is attached to one side of the second wall plate 23 without extending to the panel 24, and the joint plate 26 is joined with one side of the bottom plate 21 without facing the panel 24. Also, the bottom plate 21 is formed with a through hole 217 when the at least one auxiliary support piece 214 is formed, and the joint plate 26 holds the bottom plate 21 and partially covers with the through hole 217 when the joint plate 26 is joined with the bottom plate 21, thereby allowing the joint plate 26 to assist in supporting an area of the bottom plate 21 adjacent to the joint plate 26.

What is claimed is:

1. A paper cup-holder, comprising:

a bottom plate, formed with at least one auxiliary support piece forming line, wherein a starting point and an ending point of the at least one auxiliary support piece forming line are unconnected, and the bottom plate is formed with at least one auxiliary support piece based on the at least one auxiliary support piece forming line, and each auxiliary support piece comprises a support part bent relative to the bottom plate and a bonding plate bent relative to the support part;

a first wall plate and a second wall plate, the first wall plate connected with one side of the bottom plate and bent relative to the bottom plate, and the second wall plate being parallel to the first wall plate;

a panel, comprising two sides respectively connected with the second wall plate and the first wall plate, wherein the panel, the first wall plate, the second wall plate and the bottom plate form a tubular structure, and one side of the panel facing the bottom plate is provided with the bonding plate to be adhered so as to enable the at least one auxiliary support piece to stand in the tubular structure, the panel is formed with at least two handle forming lines symmetrically disposed, and a starting point and an ending point of each handle forming line are unconnected, the panel is formed with at least two cup receiving inlets when two handles are formed from the panel based on the at least two handle forming lines, and wherein the tubular structure is provided with a central axis connecting two tube orifices, and a long side of each handle is perpendicular to the central axis; and a joint plate, integrally extending from one of the second wall plate and the bottom plate, and the joint plate joined with the other of the second wall plate and the bottom plate.

2. The paper cup-holder of claim 1, wherein the panel is formed with a perforation forming line at locations where the two handles are predetermined to be formed, respectively.

3. The paper cup-holder of claim 1, wherein the panel is formed with two symmetrically disposed sets of handle forming lines and at least two cup receiving inlet forming lines, each set of handle forming lines comprises an outer cutting line and an inner cutting line facing the other set of handle forming lines, and a starting point and an ending point of each of the cup receiving inlet forming lines are located on the inner cutting line, and two hollowed areas are formed on the panel when the two handles are formed from the panel based on the two sets of handle forming lines, and the two hollowed areas respectively form one of the at least two cup receiving inlets together with at least one of the cup receiving inlet forming lines.

4. The paper cup-holder of claim 3, wherein the outer cutting line comprises two linear segments disposed at intervals and a continuous curve segment, wherein two ends of the continuous curve segment are respectively connected with the two linear segments.

5. The paper cup-holder of claim 4, wherein the bottom plate is formed with a through hole when the at least one auxiliary support piece is formed, the joint plate extends from the second wall plate and is connected with the bottom plate, the joint plate holds the bottom plate, and the joint plate partially covers with the through hole.

* * * * *